US009063500B2

(12) United States Patent
Gotoh et al.

(10) Patent No.: US 9,063,500 B2
(45) Date of Patent: Jun. 23, 2015

(54) LUBRICANT APPLICATOR, IMAGE FORMING APPARATUS, AND PROCESS CARTRIDGE

(71) Applicants: Ryohta Gotoh, Tokyo (JP); Satoshi Hatori, Kanagawa (JP); Naohiro Kumagai, Kanagawa (JP); Kaoru Yoshino, Tokyo (JP); Akira Fujimori, Kanagawa (JP); Hideyasu Seki, Chiba (JP)

(72) Inventors: Ryohta Gotoh, Tokyo (JP); Satoshi Hatori, Kanagawa (JP); Naohiro Kumagai, Kanagawa (JP); Kaoru Yoshino, Tokyo (JP); Akira Fujimori, Kanagawa (JP); Hideyasu Seki, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/922,516

(22) Filed: Jun. 20, 2013

(65) Prior Publication Data

US 2014/0037302 A1 Feb. 6, 2014

(30) Foreign Application Priority Data

Jul. 31, 2012 (JP) ..... 2012-169913

(51) Int. Cl.
*G03G 15/00* (2006.01)
*G03G 21/00* (2006.01)

(52) U.S. Cl.
CPC ..... *G03G 15/553* (2013.01); *G03G 21/0094* (2013.01)

(58) Field of Classification Search
CPC ..... G03G 15/553; G03G 21/0094
USPC ..... 399/24, 346, 324, 325
See application file for complete search history.

(56) References Cited

U.S. PATENT DOCUMENTS

| | | | | |
|---|---|---|---|---|
| 2005/0164108 | A1 | 7/2005 | Murakami et al. | |
| 2006/0115286 | A1 * | 6/2006 | Uchitani et al. | 399/50 |
| 2007/0059067 | A1 | 3/2007 | Tanaka et al. | |
| 2007/0172273 | A1 | 7/2007 | Harada et al. | |
| 2007/0258743 | A1 | 11/2007 | Shakuto et al. | |
| 2008/0181689 | A1 | 7/2008 | Fujimori | |
| 2009/0060600 | A1 | 3/2009 | Ninomiya et al. | |

(Continued)

FOREIGN PATENT DOCUMENTS

| | | |
|---|---|---|
| JP | 8-314346 | 11/1996 |
| JP | 2010-271665 | 12/2010 |

OTHER PUBLICATIONS

US Patent Application Hatori et al. U.S. Appl. No. 14/289,925, filed May 29, 2014.*

*Primary Examiner* — Rodney Bonnette
(74) *Attorney, Agent, or Firm* — Oblon, McClelland, Maier & Neustadt, L.L.P.

(57) ABSTRACT

A lubricant applicator includes a block of lubricant, a supply member contactable against the block of lubricant to scrape the block of lubricant, and a lubricant gauge to detect whether a remaining amount of lubricant is less than a threshold value. The lubricant gauge includes a rotary member rotatable about a pivot, a pressing member disposed opposite the rotary member to rotate the rotary member by pressing a contact part of the rotary member as the block of lubricant is consumed, and a detection part of the rotary member opposite to the contact part across the pivot of the rotary member. A length of the rotary member from the pivot to the detection part is longer than a length of the rotary member from the pivot to the contact part.

12 Claims, 10 Drawing Sheets

(56) References Cited

U.S. PATENT DOCUMENTS

| | | | | |
|---|---|---|---|---|
| 2009/0103944 | A1 | 4/2009 | Shintani et al. | |
| 2010/0183349 | A1 | 7/2010 | Shintani et al. | |
| 2011/0076075 | A1 | 3/2011 | Arai et al. | |
| 2011/0123239 | A1 | 5/2011 | Azeyanagi et al. | |
| 2011/0170908 | A1 | 7/2011 | Saitoh et al. | |
| 2011/0217101 | A1 | 9/2011 | Okamoto et al. | |
| 2011/0229232 | A1 | 9/2011 | Kojima et al. | |
| 2012/0141177 | A1* | 6/2012 | Urayama et al. | 399/346 |
| 2013/0243449 | A1 | 9/2013 | Hatori et al. | |
| 2013/0251380 | A1 | 9/2013 | Fujimori et al. | |
| 2013/0251381 | A1 | 9/2013 | Seki et al. | |
| 2013/0251382 | A1* | 9/2013 | Honjoh et al. | 399/25 |
| 2013/0279923 | A1 | 10/2013 | Gotoh et al. | |
| 2014/0037303 | A1* | 2/2014 | Tomita et al. | 399/24 |
| 2014/0037304 | A1* | 2/2014 | Uenishi et al. | 399/24 |

* cited by examiner

LUBRICANT APPLICATOR, IMAGE FORMING APPARATUS, AND PROCESS CARTRIDGE

CROSS-REFERENCE TO RELATED APPLICATION

This patent application is based on and claims priority pursuant to 35 U.S.C. §119 to Japanese Patent Application No. 2012-169913, filed on Jul. 31, 2012, in the Japan Patent Office, the entire disclosure of which is hereby incorporated by reference herein.

BACKGROUND

1. Technical Field

Exemplary aspects of the present invention generally relate to a lubricant applicator, an image forming apparatus including the lubricant applicator, and a process cartridge included in the image forming apparatus.

2. Related Art

Related-art image forming apparatuses, such as copiers, printers, facsimile machines, and multifunction devices having two or more of copying, printing, and facsimile capabilities, typically form a toner image on a recording medium (e.g., a sheet of paper, etc.) according to image data using, for example, an electrophotographic method. In the electrophotographic method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet of recording media; and a fixing device applies heat and pressure to the sheet bearing the toner image to fix the toner image onto the sheet. The sheet bearing the fixed toner image is then discharged from the image forming apparatus.

The image forming apparatuses often further include a lubricant applicator that supplies a lubricant to a surface of an image carrier, such as the photoconductor and an intermediate transfer belt included in the transfer device, for protection and reduced friction.

When image formation is performed with the lubricant used up and not supplied to the image carrier, the image carrier, which is not protected by the lubricant, abrades and deteriorates. To solve this problem, the lubricant applicator often includes a lubricant detector that detects a stage in which the lubricant is almost used up (hereinafter referred to as a near-end stage of the lubricant).

FIG. 1 is a schematic perspective view illustrating an example of a configuration of a lubricant detector included in a related-art lubricant applicator.

The lubricant applicator illustrated in FIG. 1 includes a lubricant holder 143 formed of an electrically conductive material, a solid lubricant 140 held by the lubricant holder 143, and first and second electrode members 181 and 182 that contact both ends of the lubricant holder 143, respectively, when the solid lubricant 140 has a small remaining amount. A detection circuit 183 is connected to both the first and second electrode members 181 and 182, and applies a voltage between the first and second electrode members 181 and 182 to detect whether or not an electric current flows therebetween. The lubricant holder 143 is biased toward a supply member, not shown, by springs 142.

In the early stage of use of the solid lubricant 140, the lubricant holder 143 is positioned away and thus electrically isolated from both the first and second electrode members 181 and 182, so that an electric current does not flow between the first and second electrode members 181 and 182. As the solid lubricant 140 is gradually scraped off by the supply member over time, the lubricant holder 143 is moved toward the supply member by a biasing force of the springs 142. When the solid lubricant 140 reaches the near-end stage, the conductive lubricant holder 143 contacts the first and second electrode members 181 and 182. As a result, an electric current flows between the first and second electrode members 181 and 182, so that the detection circuit 183 detects the near-end stage of the solid lubricant 140.

Thus, upon detection of the near-end stage of the solid lubricant 140, the electric current flows through the conductive lubricant holder 143 when the lubricant holder 143 contacts the first and second electrode members 181 and 182. Consequently, the solid lubricant 140 held by the lubricant holder 143 and the supply member that contacts the solid lubricant 140 acquire an electric charge, which can adversely affect image quality.

SUMMARY

In view of the foregoing, illustrative embodiments of the present invention provide a novel lubricant applicator that reliably detects that a remaining amount of a solid lubricant is smaller than a threshold value. Illustrative embodiments of the present invention also provide an image forming apparatus including the lubricant applicator, and a process cartridge included in the image forming apparatus.

In one illustrative embodiment, a lubricant applicator includes a bock of lubricant, a supply member contactable against the block of lubricant to scrape the block of lubricant, and a lubricant gauge to detect whether a remaining amount of lubricant is less than a threshold value. The lubricant gauge includes a rotary member rotatable about a pivot, a pressing member disposed opposite the rotary member to rotate the rotary member by pressing a contact part of the rotary member as the block of lubricant is consumed, and a detection part of the rotary member opposite to the contact part across the pivot of the rotary member. A length of the rotary member from the pivot to the detection part is longer than a length of the rotary member from the pivot to the contact part.

In another illustrative embodiment, an image forming apparatus includes an image carrier, from which an image formed thereon is transferred onto a recording medium to form the image on the recording medium, and the lubricant applicator described above to supply a lubricant to a surface of the image carrier.

In yet another illustrative embodiment, a process cartridge detachably installable in an image forming apparatus includes an image carrier and the lubricant applicator described above to supply a lubricant to a surface of the image carrier.

Additional features and advantages of the present disclosure will become more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
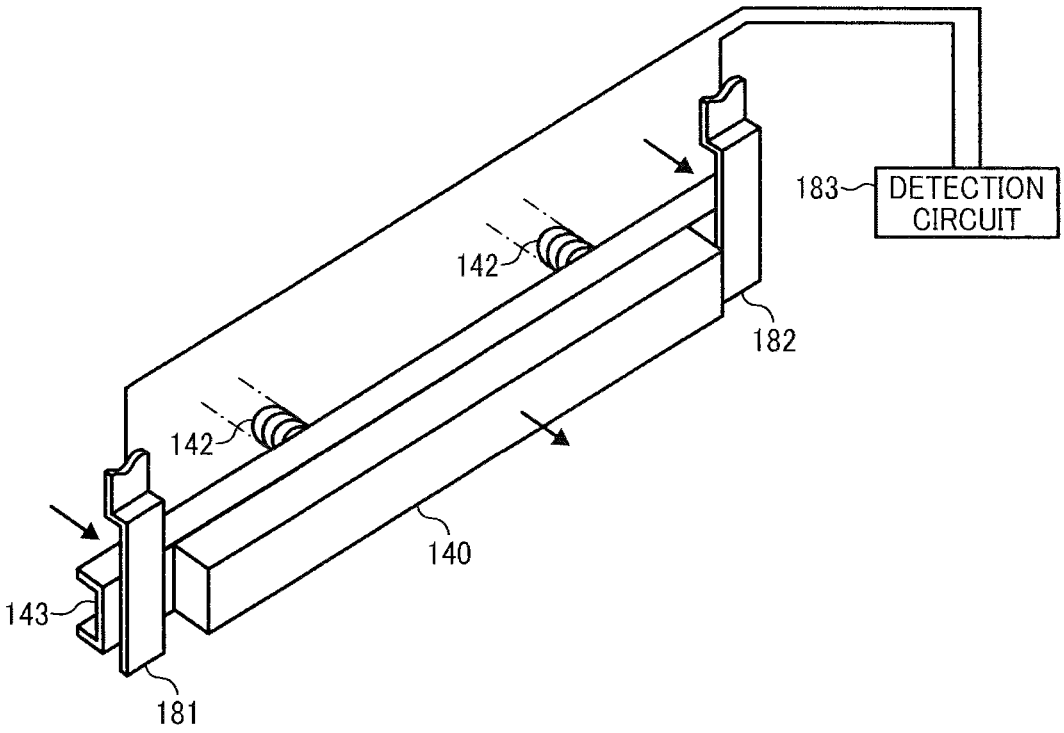
FIG. 1 RELATED ART
FIG. 1 is a schematic perspective view illustrating an example of a configuration of a lubricant detector included in a related-art lubricant applicator.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have substantially the same function, operate in a similar manner, and achieve a similar result.

Illustrative embodiments of the present invention are now described below with reference to the accompanying drawings. In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

A configuration and operation of an image forming apparatus 10 according to an illustrative embodiment are described in detail below.

Figure 2:
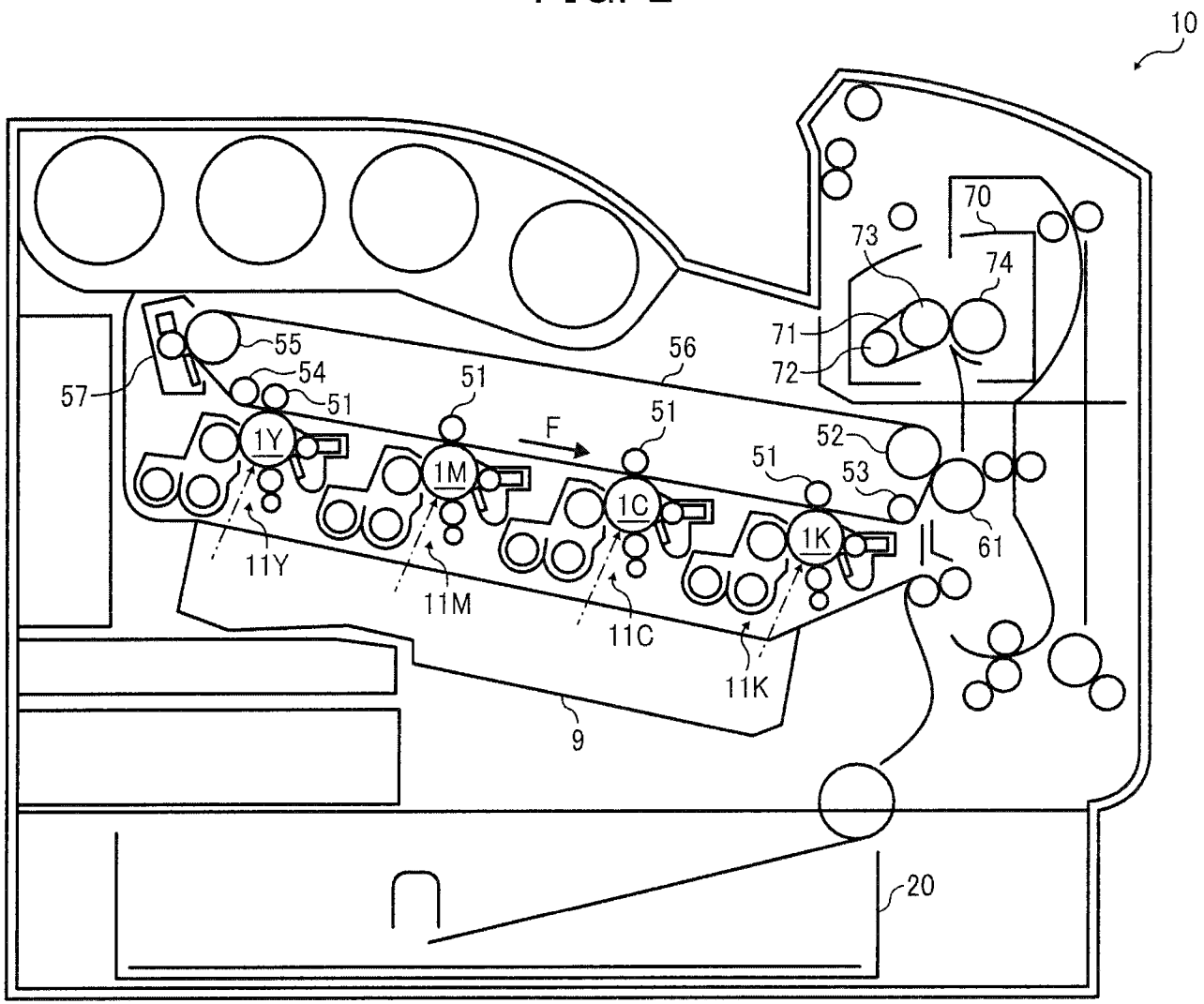
FIG. 2 is a vertical cross-sectional view illustrating an example of a configuration of an image forming apparatus according to an illustrative embodiment.

FIG. 2 is a vertical cross-sectional view illustrating an example of a configuration of the image forming apparatus 10.

The image forming apparatus 10 is a printer employing an electrophotographic method and includes an intermediate transfer belt 56 serving as an image carrier. The intermediate transfer belt 56 is an endless belt formed of a heat resistant material such as polyimide and polyamide, and includes a base with medium resistance. The intermediate transfer belt 56 is disposed substantially at the center of the image forming apparatus 10 and wound around rollers 52, 53, 54, and 55 to be rotatively driven in a counterclockwise direction indicated by arrow F in FIG. 2. Four imaging units 11Y, 11M, 11C, and 11K (hereinafter collectively referred to as imaging units 11), each forming a toner image of a specific color, that is, yellow (Y), magenta (M), cyan (C), or black (K), are disposed side by side along a direction of rotation of the intermediate transfer belt 56 below the intermediate transfer belt 56.

Figure 3:
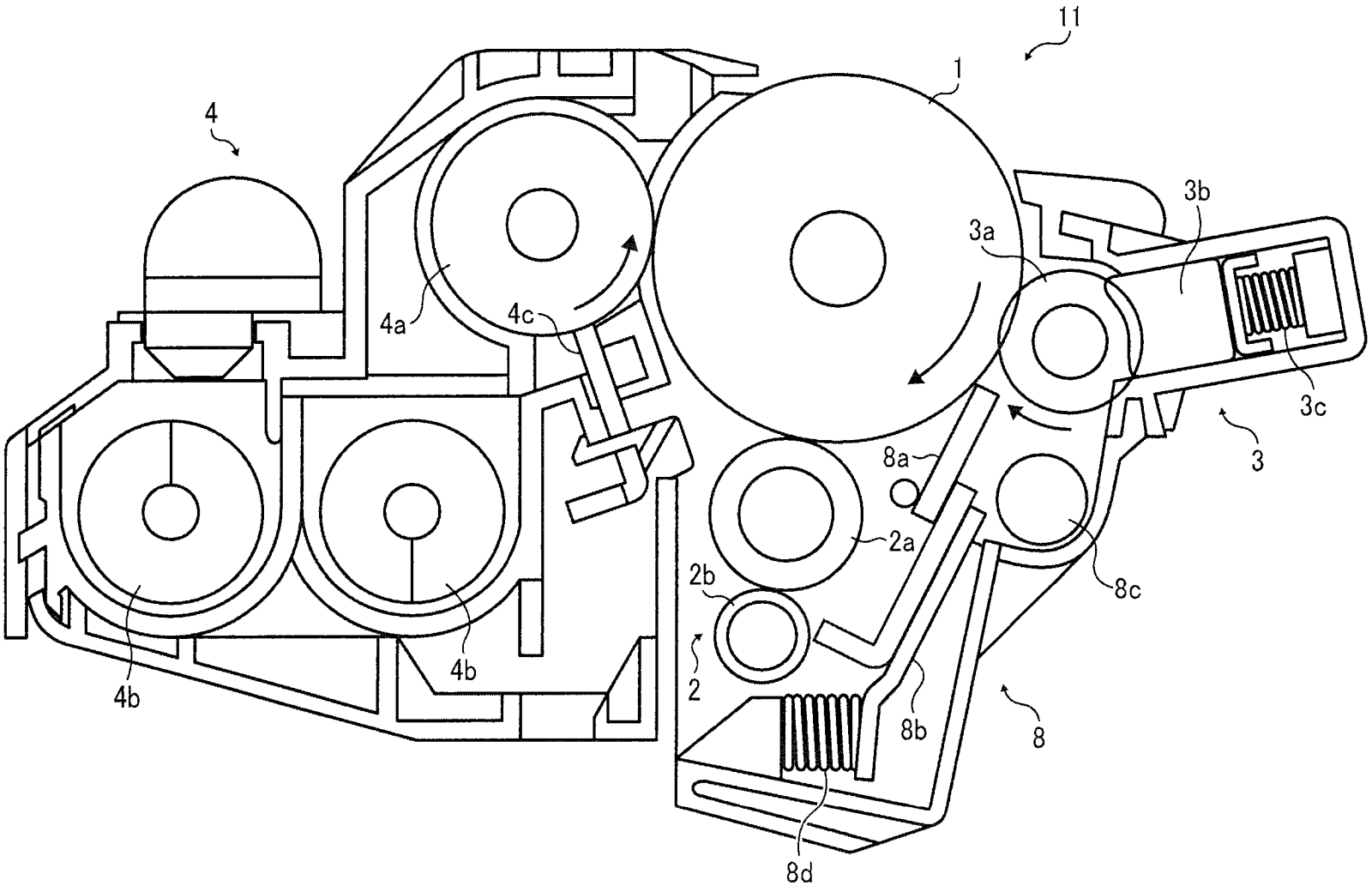
FIG. 3 is an enlarged vertical cross-sectional view illustrating an example of a configuration of a process cartridge included in the image forming apparatus.

FIG. 3 is an enlarged vertical cross-sectional view illustrating an example of a configuration of one of the imaging units 11 included in the image forming apparatus 10.

It is to be noted that the imaging units 11 have the same basic configuration, differing only in a color of toner used. Therefore, suffixes Y, M, C, and K, each indicating a color of toner used, are hereinafter omitted.

The imaging unit 11 includes an image carrier, which, in the present illustrative embodiment, is a photoconductor 1. A charger 2 that evenly charges a surface of the photoconductor 1 such that the photoconductor 1 has a predetermined negative polarity, a developing device 4 that develops an electrostatic latent image formed on the surface of the photoconductor 1 with negatively charged toner to form a toner image on the surface of the photoconductor 1, a lubricant applicator 3 that supplies lubricant to the surface of the photoconductor 1, and a cleaning device 8 that cleans the surface of the photoconductor 1 after transfer of the toner image from the photoconductor 1 onto the intermediate transfer belt 56 are disposed around the photoconductor 1.

The photoconductor 1, the charger 2, the developing device 4, the cleaning device 8, and the lubricant applicator 3, each included in the imaging unit 11, are formed together as a single integrated process cartridge detachably installable in the image forming apparatus 10, and thus integrally replaceable with a new imaging unit 11.

Returning to FIG. 2, an electrostatic latent image forming device, which, in the present illustrative embodiment, is an irradiating device 9, is disposed below the imaging units 11. The irradiating device 9 irradiates the charged surface of each photoconductor 1 with light based on image data of the corresponding color to form an electrostatic latent image on the surface of each photoconductor 1. Inside the loop of the intermediate transfer belt 56, primary transfer devices, which, in the present illustrative embodiment, are primary transfer rollers 51, are disposed opposite the photoconductors 1Y, 1M, 1C, and 1K (hereinafter collectively referred to as photoconductors 1), respectively, with the intermediate transfer belt 56 interposed therebetween. The primary transfer rollers 51 primarily transfer the toner images formed on the photoconductors 1 onto the intermediate transfer belt 56, so that the toner images are sequentially superimposed one atop the other on the intermediate transfer belt 56 to form a single full-color toner image on the intermediate transfer belt 56. The primary transfer rollers 51 are connected to a power source, not shown, by which a predetermined voltage is applied.

Outside the loop of the intermediate transfer belt 56, a secondary transfer device, which, in the present illustrative embodiment, is a secondary transfer roller 61, is disposed opposite the roller 52 with the intermediate transfer belt 56 interposed therebetween. The secondary transfer roller 61 is pressed against the roller 52 via the intermediate transfer belt 56, and is connected to a power source, not shown, by which a predetermined voltage is applied. The secondary transfer roller 61 and the intermediate transfer belt 56 contact each other at a secondary transfer position where the full-color toner image formed on the intermediate transfer belt 56 is secondarily transferred onto a recording medium such as a sheet of transfer paper. In addition, outside the loop of the intermediate transfer belt 56, a belt cleaning device 57 that cleans a surface of the intermediate transfer belt 56 after the secondary transfer of the toner image onto the transfer sheet is disposed opposite the roller 55 with the intermediate transfer belt 56 interposed therebetween. A fixing device 70 that fixes the toner image onto the transfer sheet is disposed above the secondary transfer position. The fixing device 70 includes a heat roller 72, within which a halogen heater is disposed, a fixing roller 73, an endless fixing belt 71 wound around the heat roller 72 and the fixing roller 73, and a pressing roller 74 disposed opposite the fixing roller 73 with the fixing belt 71 interposed therebetween. The pressing roller 74 is pressed against the fixing roller 73 via the fixing belt 71. A sheet feeder 20 that accommodates a transfer sheet and feeds the transfer sheet to the secondary transfer position is disposed in a lower part of the image forming apparatus 10.

The photoconductor 1 is an organic photoconductor having a protective layer formed of polycarbonate resin. The charger 2 includes a charging member, which, in the present illustrative embodiment, is a charging roller 2*a*. The charging roller 2*a* includes a conductive metal core coated with an elastic layer with medium resistance, and is connected to a power source, not shown, by which a predetermined voltage is applied. The charging roller 2*a* and the photoconductor 1 are disposed opposite each other across a minute gap. For example, a spacer member having a certain thickness may be wound around both ends of the charging roller 2*a* at a non-image forming range, so that each spacer member contacts the photoconductor 1 to form the minute gap between the charging roller 2*a* and the photoconductor 1. The charger 2 further includes a charger cleaning member 2*b* that contacts the charging roller 2*a* to clean the charging roller 2*a*.

The developing device 4 includes a developer bearing member, which, in the present illustrative embodiment, is a developing sleeve 4*a*. The developing sleeve 4*a* has a magnetic field generator therewithin and is disposed opposite the photoconductor 1. Two screws 4*b*, each mixing toner supplied from a toner bottle, not shown, with developer and supplying the developer including the toner and magnetic carrier to the developing sleeve 4*a*, are disposed below the developing sleeve 4*a*. A thickness of the developer thus supplied to the developing sleeve 4*a* is restricted by a doctor blade 4*c* so that the developing sleeve 4*a* bears the developer having a predetermined thickness. The developing sleeve 4*a* bears the developer while rotating in a counterclockwise direction in FIG. 3 to supply the toner onto the electrostatic latent image formed on the photoconductor 1. Although the developing device 4 employs a two-component developing system in the above-described example, the configuration is not limited thereto. Alternatively, the developing device 4 may employ a single-component developing system.

The lubricant applicator 3 includes a solid lubricant 3*b* accommodated within a stationary casing, and a supply member, which, in the present illustrative embodiment, is an application roller 3*a* that supplies powdered lubricant scraped off from the solid lubricant 3*b* onto the surface of the photoconductor 1. The application roller 3*a* may be constructed of a brush roller, a urethane foam roller, or the like. In a case in which the application roller 3*a* is constructed of a brush roller, it is preferable that the brush roller be formed of a material having a volume resistance of from $1\times10^3$ Ωcm to $1\times10^8$ Ωcm, in which a resistance control material such as carbon black is added to resin such as nylon and acrylic. The application roller 3*a* is rotated clockwise in FIG. 3. In other words, the application roller 3*a* is rotated in the opposite direction to the direction of rotation of the photoconductor 1 at a contact portion in which the photoconductor 1 and the application roller 3*a* contact each other. In a case in which the application roller 3*a* is constructed of a urethane foam roller, a polyurethane foam roller may be used as the application roller 3*a*.

The solid lubricant 3*b* has a square shape and is pressed against the application roller 3*a* by a pressing mechanism described in detail later. The solid lubricant 3*b* includes at least a fatty acid metal salt. Examples of the fatty acid metal salt include, but are not limited to, fluorocarbon resins, lamellar crystallization such as zinc stearate, calcium stearate, barium stearate, aluminum stearate, and magnesium stearate, lauroyl lysine, monocetyl sodium phosphate, and lauroyltaurine calcium. Of these, zinc stearate is most preferable. Zinc stearate spreads well on the surface of the photoconductor 1 and has lower hygroscopicity. In addition, zinc stearate keeps high lubricating property even under changes in humidity. Thus, a protective layer is formed of the lubricant, which has high protecting property and is less affected by environmental changes, on the surface of the photoconductor 1, thereby protecting the surface of the photoconductor 1. In addition, as described previously, the solid lubricant 3*b* keeps high lubricating property against humidity changes, so that cleaning of the surface of the photoconductor 1 is preferably performed. It is to be noted that, alternatively, liquid materials such as silicone oil, fluorocarbon oil, and natural wax, or gaseous materials may be added to the fatty acid metal salt to produce the solid lubricant 3*b*.

It is also preferable that the solid lubricant 3*b* include an inorganic lubricant such as boron nitride. Examples of crystalline structures of boron nitride include, but are not limited to, low-pressure phase hexagonal boron nitride (h-BN) and high-pressure phase cubic boron nitride (c-BN). Of these, low-pressure phase hexagonal boron nitride has a layered structure and is easily cleaved, so that low coefficient of friction at less than 0.2 is kept up to around 400° C. In addition, characteristics of low-pressure phase hexagonal boron nitride are less affected by electrical discharge. Therefore, compared to other materials, low-pressure phase hexagonal boron more reliably keeps lubricating property even when an electric discharge is applied. Addition of boron nitride to the solid lubricant 3*b* prevents early deterioration of the lubricant supplied to the surface of the photoconductor 1 caused by electric discharge generated during operation of the charger 2 or the primary transfer rollers 51. Characteristics of boron nitride are not easily changed by the electric discharge and thus the lubricating property of boron nitride is not lost by the electric discharge compared to other types of lubricants. Further, boron nitride prevents a photoconductive layer of the photoconductor 1 from being oxidized and volatilized by the electric discharge. Even a small additive amount of boron nitride provides good lubricating property, thereby effectively preventing chatter of a cleaning blade 8*a*, which is described later, and problems caused by adherence of the lubricant to the charging roller 2*a* or the like.

Materials including zinc stearate and boron nitride are compressed to form the solid lubricant 3*b*. It is to be noted that a method for forming the solid lubricant 3*b* is not limited to the compression process. Alternatively, the solid lubricant 3*b* may be formed by melt process. Thus, the solid lubricant 3*b* has the effects of both zinc stearate and boron nitride.

Although the solid lubricant 3*b* is consumed by being scraped off by the application roller 3*a* and thus a thickness of the solid lubricant 3*b* is reduced over time, the pressing mechanism constantly presses the solid lubricant 3*b* against the application roller 3*a*. The application roller 3*a* supplies the lubricant scraped off from the solid lubricant 3*b* to the surface of the photoconductor 1 while rotating. Thereafter, the lubricant supplied to the surface of the photoconductor 1 is spread and leveled by the cleaning blade 8*a* that contacts the surface of the photoconductor 1, so that the surface of the photoconductor 1 has a thin layer of the lubricant thereon. As a result, a frictional factor on the surface of the photoconductor 1 is reduced. It is to be noted that the layer of the lubricant adhering to the surface of the photoconductor 1 is too thin to prevent the photoconductor 1 from being charged by the charging roller 2*a*.

The cleaning device 8 includes a cleaning member, which, in the present illustrative embodiment, is the cleaning blade 8*a*, a support member 8*b*, a toner collection coil 8*c*, and a pressing spring 8*d*. The cleaning blade 8*a* is constructed of a rubber plate formed of urethane rubber, silicone rubber, or the like, and one end of the cleaning blade 8*a* contacts the surface of the photoconductor 1 to remove residual toner from the surface of the photoconductor 1 after the primary transfer of the toner image from the photoconductor 1 onto the intermediate transfer belt 56. The cleaning blade 8*a* is bonded to and supported by the support member 8*b* formed of metal, plastics, ceramics, or the like, and is disposed opposite the photoconductor 1 at a certain angle. The pressing spring 8*d* presses the cleaning blade 8*a* against the photoconductor 1 so that the cleaning blade 8*a* contacts the photoconductor 1 with a certain amount of engagement and pressure. It is to be noted that not only the cleaning blade 8*a* but also a well-know cleaning member such as a cleaning brush may be used as the cleaning member of the cleaning device 8.

The lubricant applicator 3 is disposed downstream from a primary transfer position, where the photoconductor 1 and the primary transfer roller 51 face each other, and upstream from the cleaning device 8 in the direction of rotation of the photoconductor 1. The lubricant supplied to the surface of the photoconductor 1 by the lubricant applicator 3 is spread across the surface of the photoconductor 1 by the cleaning blade 8*a* so that the lubricant is roughly leveled on the surface of the photoconductor 1. Alternatively, the lubricant applicator 3 may be disposed downstream from a cleaning position, where the photoconductor 1 and the cleaning device 8 face each other, and upstream from a charging position, where the photoconductor 1 and the charger 2 face each other. In such a configuration, in a case in which the imaging unit 11 further includes a neutralizing device that neutralizes the surface of the photoconductor 1 before charging of the surface of the photoconductor 1 by the charger 2, the lubricant applicator 3 is disposed upstream from a neutralizing position, where the photoconductor 1 and the neutralizing device face each other.

In the present illustrative embodiment, the lubricant applicator 3 is disposed within the cleaning device 8. Thus, toner that adheres to the application roller 3*a* contacting the surface of the photoconductor 1 is removed by the solid lubricant 3*b* or a flicker, not shown, so that the toner collection coil 8*c* easily collects the toner thus removed, together with toner collected by the cleaning blade 8*a*.

Figure 4:
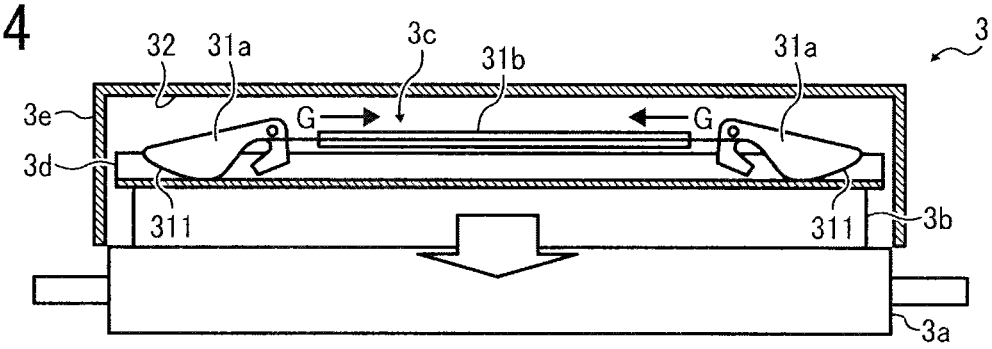
FIG. 4 is a vertical cross-sectional view illustrating an example of a configuration of a lubricant applicator according to the illustrative embodiment.

A description is now given of a detailed configuration of the lubricant applicator 3. FIG. 4 is a vertical cross-sectional view illustrating an example of a configuration of the lubricant applicator 3.

The lubricant applicator 3 further includes a lubricant holder 3*d* that holds, across the longitudinal direction, an opposite face of the solid lubricant 3*b* opposite a contact face contacted by the application roller 3*a*. The lubricant holder 3*d* is disposed within a casing 3*e* and is provided separatably contactable against the application roller 3*a*. A pressing mechanism 3*c* including a pressure spring that presses the solid lubricant 3*b* against the application roller 3*a* is disposed above the lubricant holder 3*d* within the casing 3*e*.

The pressing mechanism 3*c* is constructed of swinging members 31*a* swingably provided to the casing 3*e* near both ends of the lubricant holder 3*d* in the longitudinal direction, respectively, and a biasing member, that is, a spring 31*b*. Specifically, both ends of the spring 31*b* are mounted to the respective swinging members 31*a*. The swinging members 31*a* are biased inward to the center of the lubricant holder 3*d* in the longitudinal direction as indicated by arrows G in FIG. 4 by the spring 31*b*. Accordingly, the swinging member 31*a* positioned on the right in FIG. 4 swings in a counterclockwise direction, and the swinging member 31*a* positioned on the left in FIG. 4 swings in a clockwise direction. As a result, an arc-shaped edge portion 311 of each swinging member 31*a* that contacts the lubricant holder 3*d* is biased toward the lubricant holder 3*d* as illustrated in FIG. 4.

In the early stage of use of the solid lubricant 3*b*, the swinging members 31*a* swing toward an inner surface 32 of an upper portion of the casing 3*e* against the biasing force of the spring 31*b*. Such a configuration enables the swinging members 31*a* biased by the spring 31*b* to press against the lubricant holder 3*d* with an equal force, so that the solid lubricant 3*b* held by the lubricant holder 3*d* is evenly pressed against the application roller 3*a* across the longitudinal direction. As a result, an amount of lubricant scraped off by rotation of the application roller 3*a* is equal across the longitudinal direction, and therefore, the lubricant is evenly supplied to the surface of the photoconductor 1.

Figure 5:
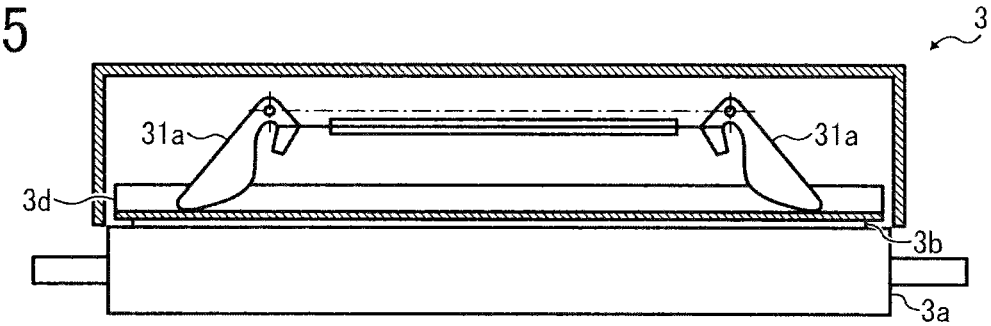
FIG. 5 is a vertical cross-sectional view of the lubricant applicator illustrated in FIG. 4 in the last stage of use of a solid lubricant.

FIG. 5 is a vertical cross-sectional view of the lubricant applicator 3 in the last stage of use of the solid lubricant 3*b*, in which the solid lubricant 3*b* has only a slight amount remaining.

The swinging members 31*a* swing as the solid lubricant 3*b* is gradually scraped off by the application roller 3*a* over time, so that the lubricant holder 3*d* is moved toward the application roller 3*a*. Ultimately, when the solid lubricant 3*b* has only a slight amount remaining, a free end of each swinging member 31*a* contacts the lubricant holder 3*d* as illustrated in FIG. 5.

Thus, the pressing mechanism 3*c* presses the solid lubricant 3*b* against the application roller 3*a* with substantially the same force over time even as the solid lubricant 3*b* is reduced. As a result, unevenness in the amount of powdered lubricant scraped off by the application roller 3*a* and supplied to the surface of the photoconductor 1 is minimized from the early stage to the last stage of use of the solid lubricant 3*b*.

The following are reasons for obtaining the above-described effects.

In general, the longer the length of the spring 31*b*, the smaller the variation in a biasing force of the spring 31*b* relative to a change in an amount of extension of the spring 31*b* from the early stage to the last stage of use of the solid lubricant 3*b*. In related-art pressing mechanisms, a spring in a compressed state is disposed within the casing, and a direction of a biasing force of the spring is identical to a direction in which the solid lubricant is pressed against the application roller. In such a configuration, the longer the length of the spring, the more difficult it is to set the direction of the biasing force of the spring to be identical to the direction in which the solid lubricant is pressed against the application roller. Thus, the length of the spring is limited. Further, in the related-art pressing mechanisms, a space for the length of the spring is needed in a direction of the diameter of the application roller, resulting in an increase in the overall size of the lubricant applicator. For these reasons, a relatively short spring is used in the related-art pressing mechanisms, making the mechanisms vulnerable to variation in the biasing force of the spring over time.

By contrast, in the pressing mechanism 3*c* according to the present illustrative embodiment, the spring 31*b* in the extended state is disposed within the casing 3*e* as illustrated in FIG. 4, and a tractive force of the spring 31*b* is used for pressing the solid lubricant 3*b* against the application roller 3*a*. Thus, even the longer spring 31*b* does not cause the problems of the related-art pressing mechanisms described above. In addition, in the pressing mechanism 3*c* of the present embodiment, the spring 31*b* is disposed such that the longitudinal direction of the spring 31*b* is identical to the longitudinal direction of the solid lubricant 3*b*, that is, an axial direction of the application roller 3*a*. Therefore, use of the longer spring 31*b* does not increase a space for the spring 31*b* in the direction of diameter of the application roller 3*a*, thereby allowing the lubricant applicator 3 to be made more compact. Thus, the pressing mechanism 3*c* according to the present illustrative embodiment employs the spring 31*b*, which is considerably longer than the spring used in the related-art pressing mechanisms. As a result, variation in the biasing force of the spring 31*b* over time is minimized.

Figure 6:
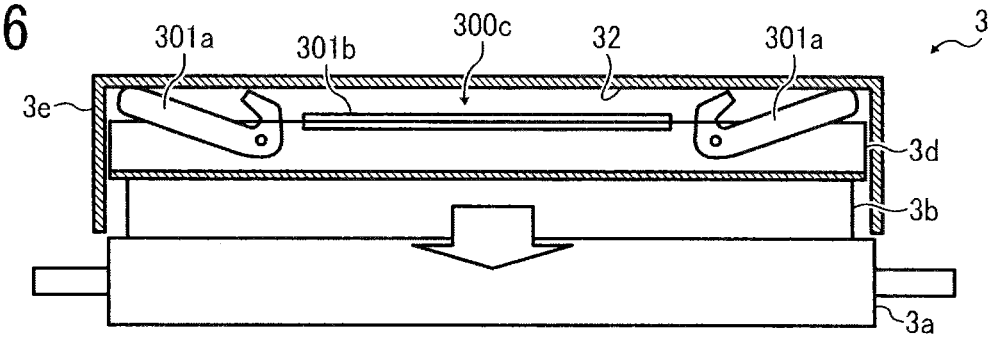
FIG. 6 is a vertical cross-sectional view illustrating another example of a configuration of a lubricant applicator according to the illustrative embodiment.

A description is now given of another example of a configuration of the lubricant applicator 3. FIG. 6 is a vertical cross-sectional view illustrating another example of a configuration of the lubricant applicator 3. In place of the pressing mechanism 3*c*, the lubricant applicator 3 illustrated in FIG. 6 includes a pressing mechanism 300*c*.

The pressing mechanism 300*c* is constructed of swinging members 301*a*, each of which is swingably mounted to the lubricant holder 3*d*, and a spring 301*b*. The spring 301*b* biases the swinging members 301*a* toward the center of the lubricant holder 3*d* in the longitudinal direction so that a free end of each swinging member 301*a* is biased away from the lubricant holder 3*d* to contact the inner surface 32 of the upper portion of the casing 3*e*.

Figure 7:
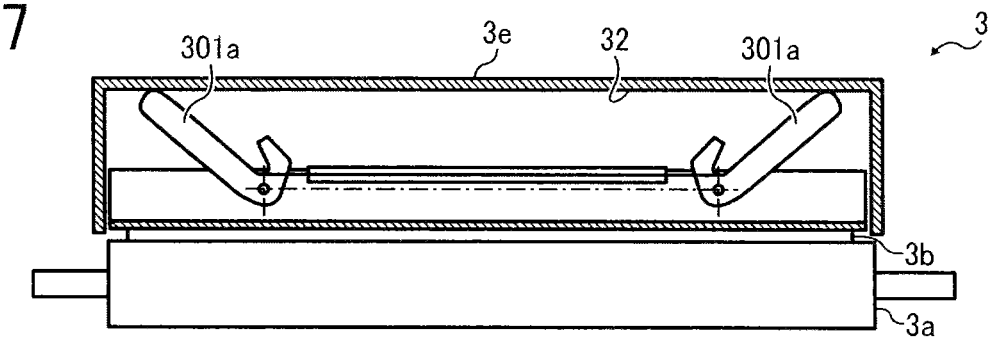
FIG. 7 is a vertical cross-sectional view of the lubricant applicator illustrated in FIG. 6 in the last stage of use of a solid lubricant.

In the early stage of use of the solid lubricant 3*b*, the free end of each swinging member 301*a* swings toward the lubricant holder 3*d* against the biasing force of the spring 301*b* as illustrated in FIG. 6. The swinging members 301*a* are biased by the spring 301*b* to press against the inner surface 32 of the casing 3*e* equally, so that the solid lubricant 3*b* held by the lubricant holder 3*d* is pressed against the application roller 3*a*. The swinging members 301*a* swing as the solid lubricant 3*b* is gradually scraped off by the application roller 3*a* over time, so that the lubricant holder 3*d* is moved toward the application roller 3*a*. Ultimately, when the solid lubricant 3*b* has only a slight amount remaining, the swinging members 301*a* swing to the state illustrated in FIG. 7.

Figure 8:
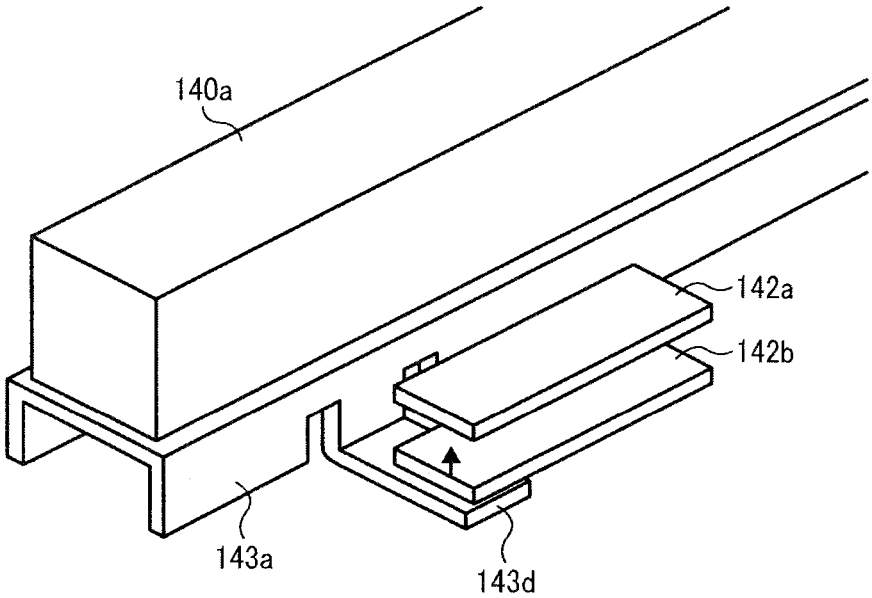
FIG. 8 is a partial enlarged view of a prototype lubricant applicator.

A description is now given of a prototype lubricant applicator with reference to FIG. 8, built and tested in light of the problems of the related-art lubricant applicator described previously in the background section above. To detect a stage in which the lubricant is almost used up and has only a slight amount remaining (hereinafter referred to as a near-end stage of the lubricant), the prototype lubricant applicator includes first and second electrode members 142*a* and 142*b* disposed opposite each other and a lubricant holder 143*a* that holds a solid lubricant 140*a*. The lubricant holder 143*a* has a projection 143*d* that presses the second electrode member 142*b* against the first electrode member 142*a*. As the solid lubricant 140*a* is consumed and approaches the near-end stage, the lubricant holder 143*a* is moved toward a supply member, not shown, so that the projection 143*d* of the lubricant holder 143*a* contacts the second electrode member 142*b*. When the solid lubricant 140*a* is further scraped off of the supply member, the projection 143*d* of the lubricant holder 143*a* presses the second electrode member 142*b* against the first electrode member 142*a*. Thereafter, when the solid lubricant 140*a* reaches the near-end stage, the second electrode member 142*b* contacts the first electrode member 142*a* to establish electrical continuity between the first and second electrode members 142*a* and 142*b*, so that the near-end stage of the solid lubricant 140*a* is detected.

In the prototype lubricant applicator, the lubricant holder 143*a* is formed of a nonconductive material, and the projection 143*d* of the lubricant holder 143*a* contacts the second electrode member 142*b* via a nonconductive member, not shown. Accordingly, an electric current does not flow the lubricant holder 143*a* even in the near-end stage of the solid lubricant 140*a*, thereby preventing the solid lubricant 140*a* and the supply member, not shown, from being charged.

The second electrode member 142*b* is elastically deformable to contact the first electrode member 142*a*. As a result, when the second electrode member 142*b* elastically deforms, the lubricant holder 143*a* receives a reactive force from the second electrode member 142*b*. A direction of the reactive force received by the lubricant holder 143*a* is opposite a direction in which the lubricant holder 143*a* presses the solid lubricant 140*a* against the supply member. Thus, upon deformation of the second electrode member 142*b*, a force that presses the solid lubricant 140*a* against the supply member by the lubricant holder 143*a* is reduced, and therefore, an amount of lubricant scraped off by the supply member is reduced, thereby reducing an amount of lubricant supplied to a target. For these reasons, it is preferable that the lubricant holder 143*a* be configured to contact the second electrode member 142*b* immediately before the solid lubricant 140*a* reaches the near-end stage, and such a configuration reduces an amount of movement of the lubricant holder 143*a* from when the lubricant holder 143*a* contacts the second electrode member 142*b* to when the solid lubricant 140*a* reaches the near-end stage.

In the prototype lubricant applicator illustrated in FIG. 8, the amount of movement of the lubricant holder 143*a* is equal to an amount of movement of the second electrode member 142*b*. In other words, the reduction in the amount of movement of the lubricant holder 143*a* equally reduces the amount of movement of the second electrode member 142*b* pressed by the lubricant holder 143*a* until the solid lubricant 140*a* reaches the near-end stage. Accordingly, a gap between the first and second electrode members 142*a* and 142*b* is reduced in order to contact the second electrode member 142*b* with the first electrode member 142*a* when the solid lubricant 140*a* reaches the near-end stage. Consequently, when the second electrode member 142*b* vibrates due to vibration generated in the image forming apparatus or the like, the second electrode member 142*b* inadvertently contacts the first electrode member 142*a*. As a result, electrical continuity (an electrical circuit) is established between the first and second electrode members 142*a* and 142*b* even when the solid lubricant 140*a* is not yet used up, causing erroneous detection of the near-end stage of the solid lubricant 140*a*. For these reasons, in the prototype lubricant applicator, it is difficult to configure the lubricant holder 143*a* to contact the second electrode member 142*b* immediately before the solid lubricant 140*a* reaches the near-end stage.

In addition, in the prototype lubricant applicator, the second electrode member 142*b* directly contacts the lubricant holder 143*a*. Therefore, the first and second electrode members 142*a* and 142*b* are disposed near a contact portion in which the supply member, not shown, contacts the solid lubricant 140*a*. Consequently, powdered lubricant, which is scraped off from the solid lubricant 140*a* by the supply member, may adhere to the first and second electrode members 142*a* and 142*b*. Adherence of the powdered lubricant to the first and second electrode members 142*a* and 142*b* hinders establishment of the electrical continuity (electrical circuit) between the first and second electrode members 142*a* and 142*b* even when the first and second electrode members 142*a* and 142*b* contact each other, thereby hindering accurate detection of the near-end stage of the solid lubricant 140*a*.

A description is now given of a lubricant gauge 40 that detects the near-end stage of the solid lubricant 3*b*.

Figure 9A:
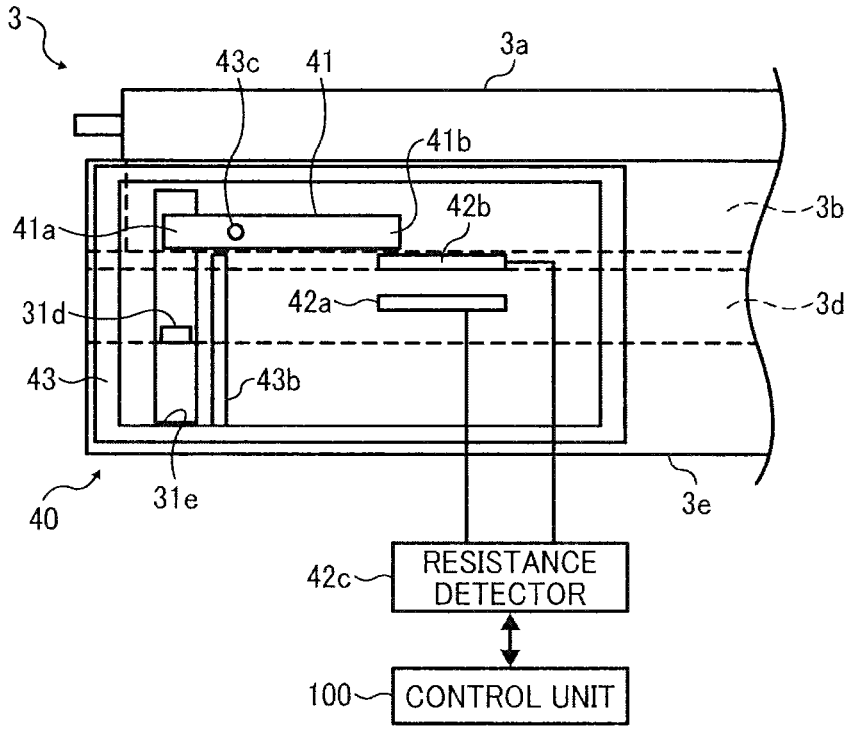
FIG. 9A is a schematic view illustrating an example of a configuration of a lubricant gauge in the early stage of use of the solid lubricant.
Figure 9B:
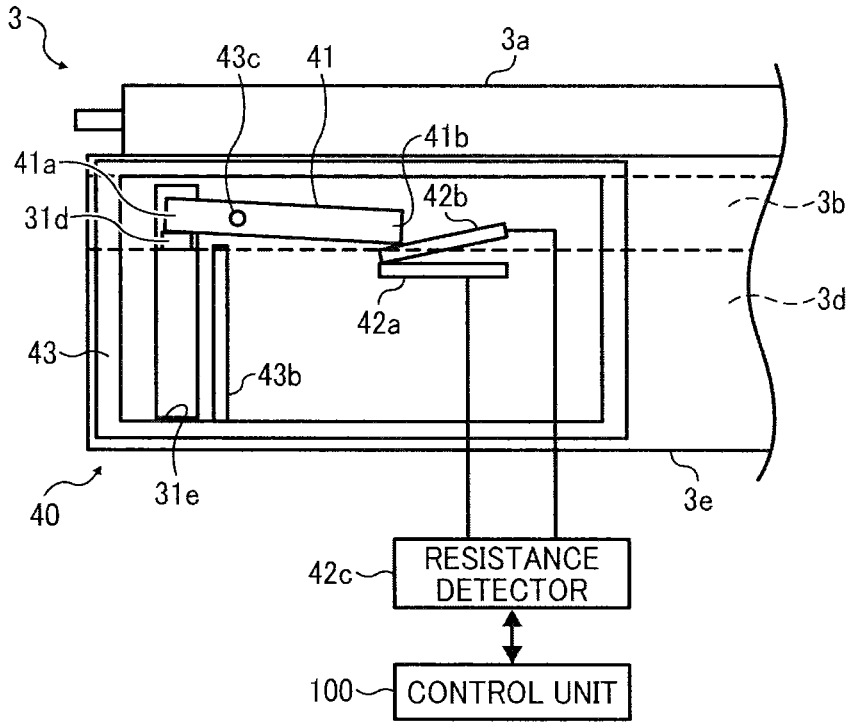
FIG. 9B is a schematic view of the lubricant gauge in a near-end stage of the solid lubricant.

FIG. 9A is a schematic view illustrating an example of a configuration of the lubricant gauge 40 in the early stage of use of the solid lubricant 3*b*. FIG. 9B is a schematic view of the lubricant gauge 40 in the near-end stage of the solid lubricant 3*b* in which the solid lubricant 3*b* is almost used up and has only a slight amount remaining. It is to be noted that, although only one end of the lubricant applicator 3 is shown in FIGS. 9A and 9B, both ends of the lubricant applicator 3 in the longitudinal direction have the same basic configuration.

The lubricant gauge 40 is disposed near both ends of the solid lubricant 3*b* in the longitudinal direction and is mounted to lateral surfaces of the casing 3*e*. Each lubricant gauge 40 includes a rotary member 41, a first electrode member 42*a*, a second electrode member 42*b* disposed opposite the first electrode member 42*a*, and a resistance detector 42*c*. The resistance detector 42*c* is connected to both the first and second electrode members 42*a* and 42*b*, and applies a voltage between the first and second electrode members 42*a* and 42*b* to measure an electric resistance. The resistance detector 42*c* is also connected to a control unit 100. The rotary member 41 and the first and second electrode members 42*a* and 42*b* are covered with and held by a cover member 43.

In the present embodiment, each of the first and second electrode members 42*a* and 42*b* is constructed of a planar conductive member such as sheet metal. The cover member 43 holds the second electrode member 42*b* such that a left end of the second electrode member 42*b* in FIGS. 9A and 9B is bent toward the first electrode member 42*a*.

An opening 31*e* extending in a direction of movement of the lubricant holder 3*d* is formed in the lateral surface of the casing 3*e*. A pressing member 31*d* provided to the lubricant holder 3*d* penetrates the opening 31*e*. The cover member 43 includes a partition wall 43*b* that divides an internal space covered with the cover member 43 into two sections, that is, a first space within which the opening 31*e* is provided and a second space within which the first and second electrode members 42*a* and 42*b* are disposed.

The rotary member 41 is rotatably supported by a rotary shaft 43*c* provided to the cover member 43. A left end of the rotary member 41 in FIGS. 9A and 9B, which, in the present illustrative embodiment, is a contact part 41*a* of the rotary member 41, is positioned opposite the pressing member 31*d*. A right end of the rotary member 41 in FIGS. 9A and 9B, which, in the present illustrative embodiment, is a detection part 41*b* of the rotary member 41, is contactable against the second electrode member 42*b*.

In the early stage of use of the solid lubricant 3*d*, the pressing member 31*d* provided to the lubricant holder 3*d* is positioned away from the rotary member 41 as illustrated in FIG. 9A, so that the rotary member 41 is placed on the second electrode member 42*b*. At this time, the second electrode member 42*b* is positioned away from the first electrode member 42*a*. Therefore, an electric current does not flow between the first and second electrode members 42*a* and 42*b* even when the resistance detector 42*c* applies a voltage between the first and second electrode members 42*a* and 42*b*, and thus the resistance detector 42*c* does not measure an electric resistance.

As the solid lubricant 3*b* is gradually scraped off by the application roller 3*a* and is reduced over time, the lubricant holder 3*d* is moved toward the application roller 3*a*. As the solid lubricant 3*b* is consumed, the pressing member 31*d* provided to the lubricant holder 3*d* contacts the rotary member 41. Thereafter, when the solid lubricant 3*b* is further scraped off by the application roller 3*a* and thus is further reduced, the contact part 41*a* of the rotary member 41, that is, the left end of the rotary member 41 in FIGS. 9A and 9B, is pressed by the pressing member 31*d*. As a result, the rotary member 41 is rotated clockwise in FIG. 9A so that the detection part 41*b* of the rotary member 41, that is, the right end of the rotary member 41, presses the second electrode member 42*b* against the first electrode member 42*a*. When the solid lubricant 3*b* reaches the near-end stage, the second electrode member 42*b* contacts the first electrode member 42*a* as illustrated in FIG. 9B. Accordingly, electrical continuity is established between the first and second electrode members 42*a* and 42*b*. Thus, application of a voltage between the first and second electrode members 42*a* and 42*b* by the resistance detector 42*c* generates an electric current between the first and second electrode members 42*a* and 42*b*, and the resistance detector 42*c* measures an electric resistance.

The control unit 100 monitors the result measured by the resistance detector 42*c*. When the resistance detector 42*c* detects that the electric resistance thus measured is less than a threshold value, the control unit 100 determines that the solid lubricant 3*b* reaches the near-end stage. Then, the control unit 100 reports to an operating unit, not shown, that the solid lubricant 3*b* is almost used up to prompt a user to replace the solid lubricant 3*b* with a new solid lubricant. Alternatively, a communication unit, not shown, may be used to notify a service center of replacement for the solid lubricant 3*b*.

The amount of the lubricant supplied to the photoconductor 1 is not constant but varies depending on an area ratio of an image formed on the surface of the photoconductor 1. Specifically, upon the primary transfer of the toner image onto the intermediate transfer belt 56 from the surface of the photoconductor 1, onto which the lubricant is supplied by the lubricant applicator 3, such lubricant may be also transferred onto the intermediate transfer belt 56, together with the toner image, from the surface of the photoconductor 1. Thus, compared to the surface of the photoconductor 1 onto which a toner image with a lower area ratio is formed, the surface of the photoconductor 1 onto which a toner image with a higher area ratio is formed has a smaller amount of lubricant thereon after the primary transfer of the toner image from the surface of the photoconductor 1 onto the intermediate transfer belt 56. As a result, a larger amount of lubricant is supplied to the surface of the photoconductor 1, onto which the toner image with a higher area ratio is formed. For these reasons, consumption of the solid lubricant 3*b* differs between a case in which the image with a lower area ratio such as a letter is often formed and a case in which the image with a higher area ratio such as a photograph is often formed. Unlike the present illustrative embodiment, if the near-end stage of the solid lubricant is determined only by an operating time such as a cumulative distance traveled by the application roller, accurate detection of the near-end stage of the solid lubricant under all usage conditions is not possible. For example, in a case in which the near-end stage of the solid lubricant is determined by the cumulative distance traveled by the application roller for a usage condition in which the solid lubricant is heavily consumed, replacement of the solid lubricant, which is not used up yet under a usage condition in which the solid lubricant is less consumed, may be prompted. Conversely, in a case in which the near-end stage of the solid lubricant is determined by the cumulative distance traveled by the application roller for the usage condition in which the solid lubricant is less consumed, the sold lubricant may be used up before the detection of the near-end stage under the usage condition in which the solid lubricant is heavily consumed.

By contrast, in the present illustrative embodiment, the near-end stage of the solid lubricant 3*b* is detected by the lubricant gauges 40 based on the height of the solid lubricant 3*b*. As a result, the near-end stage of the solid lubricant 3*b* is more accurately detected, regardless of the usage conditions, compared to the configuration in which the cumulative distance traveled by the application roller is used for determining the near-end stage of the solid lubricant.

In addition, in the present illustrative embodiment, electrical continuity between the first and second electrode members 42*a* and 42*b* is not established until the rotary member 41 is moved to the position to detect the near-end stage of the solid lubricant 3*b*. Therefore, an electric current does not flow between the first and second electrode members 42*a* and 42*b* in such a state even when a voltage is applied between the first and second electrode members 42*a* and 42*b*. As a result, electric power is not consumed each time the detection of the near-end stage of the solid lubricant 3*b* is performed, thereby reducing power consumption. In addition, in the present embodiment the first and second electrode members 42*a* and 42*b* are formed of a relatively inexpensive material such as sheet metal. Thus, the remaining amount of the solid lubricant 3*b* is accurately detected at reduced cost.

In the lubricant gauge 40 according to the present illustrative embodiment, the lubricant holder 3*d* indirectly presses the second electrode member 42*b*, via the rotary member 41, against the first electrode member 42*a*. With such a configuration, as illustrated in FIG. 9A, the first and second electrode members 42*a* and 42*b* are disposed away from a contact portion in which the solid lubricant 3*b* and the application roller 3*a* contact each other. As a result, adherence of the powdered lubricant scraped off from the solid lubricant 3*b* by the application roller 3*a* to the first and second electrode members 42*a* and 42*b* is prevented. Thus, irregular electrical continuity between the first and second electrode members 42*a* and 42*b* caused by adherence of the powdered lubricant to the first and second electrode members 42*a* and 42*b* is prevented, thereby accurately detecting the near-end stage of the solid lubricant 3*b*.

In addition, the lubricant gauge 40 is disposed outside the casing 3*e*. Thus, adherence of scattered powdered lubricant to the first and second electrode members 42*a* and 42*b* is also prevented.

Further, the opening 31*e* and the first and second electrode members 42*a* and 42*b* are covered with the cover member 43. Accordingly, the powdered lubricant is prevented from scattering outside the lubricant applicator 3 via the opening 31*e*, thereby preventing the interior of the image forming apparatus 10 from getting contaminated. In addition, adherence of the scattered toner to the first and second electrode members 42*a* and 42*b* is prevented, thereby preventing irregular electrical continuity between the first and second electrode members 42*a* and 42*b*.

As described previously, the partition wall 43*b* included in the cover member 43 divides the internal space encompassed by the cover member 43 into the first space, within which the opening 31*e* is provided, and the second space, within which the first and second electrode members 42*a* and 42*b* are disposed. As a result, even when the powdered lubricant enters the internal space via the opening 31*e*, adherence of the powdered lubricant to the first and second electrode members 42*a* and 42*b* is further prevented by the partition wall 43*b*.

It is preferable that the cover member 43 and the partition wall 43*b* be formed together of resin as a single integrated component. Thus, compared to a configuration in which the cover member 43 and the partition wall 43*b* are individually provided, number of components is reduced, thereby reducing production costs. Alternatively, the partition wall 43*b* may be provided to the casing 3*e*. In such a case, it is preferable that the casing 3*e* and the partition wall 43*b* be formed together of resin as a single integrated component, so that the number of components is reduced, thereby reducing production costs. Further alternatively, both the cover member 43 and the casing 3*e* may have a partition wall, and combined together so that the space encompassed by the cover member 43 is divided into the first space, within which the opening 31*e* is provided, and the second space, within which the first and second electrode members 42*a* and 42*b* are disposed.

In the present illustrative embodiment, the cover member 43 holds the first and second electrode members 42*a* and 42*b* and the rotary member 41. Because the first and second electrode members 42*a* and 42*b* and the rotary member 41 are held by the same member, that is, the cover member 43, accumulation of tolerances is minimized. Accordingly, the first and second electrode members 42*a* and 42*b* and the rotary member 41 are accurately positioned relative to one another. As a result, the second electrode member 42*b* reliably contacts the first electrode member 42*a* when the solid lubricant 3*b* reaches the near-end stage, thereby accurately detecting the near-end stage of the solid lubricant 3*b*. In addition, the lubricant gauge 40 is easily detached from the lubricant applicator 3 by simply removing the cover member 43 from the casing 3*e*, thereby facilitating replacement of the lubricant gauge 40.

In the present illustrative embodiment, a length B from a pivot of the rotary member 41, which, in the present illustrative embodiment, is the rotary shaft 43*c*, to the detection part 41*b* of the rotary member 41 that presses the second electrode member 42*b* against the first electrode member 42*a*, that is, the right end of the rotary member 41 in FIGS. 9A and 9B, is longer than a length A from the rotary shaft 43*c* to the contact part 41*a* of the rotary member 41 against which the pressing member 31*d* presses, that is, the left end of the rotary member 41.

Figure 10:
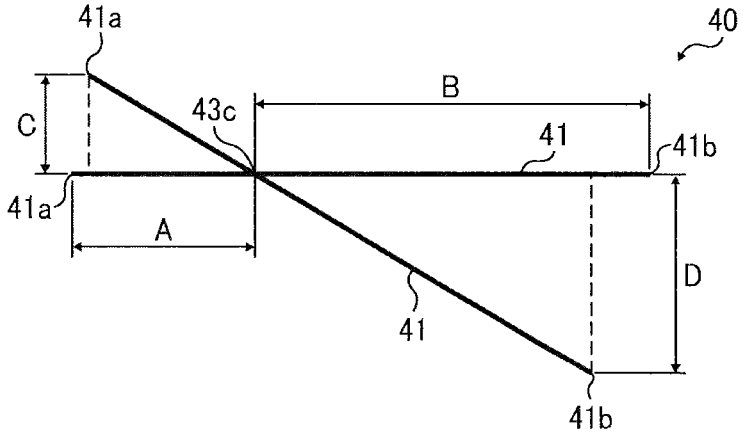
FIG. 10 is a schematic view illustrating relations between a position of a pivot of a rotary member included in the lubricant gauge and an amount of movement of each of a contact part and a detection part of the rotary member.

FIG. 10 is a schematic view illustrating relations between a position of the pivot of the rotary member 41 and an amount of movement of each of the contact part 41*a* and the detection part 41*b* of the rotary member 41. When the rotary member 41 is rotated at a predetermined angle, an amount of vertical movement C of the contact part 41*a* of the rotary member 41, which is positioned closer to the rotary shaft 43*c*, is smaller than an amount of vertical movement D of the detection part 41*b* of the rotary member 41, which is positioned farther from the rotary shaft 43*c*.

Figure 11A:
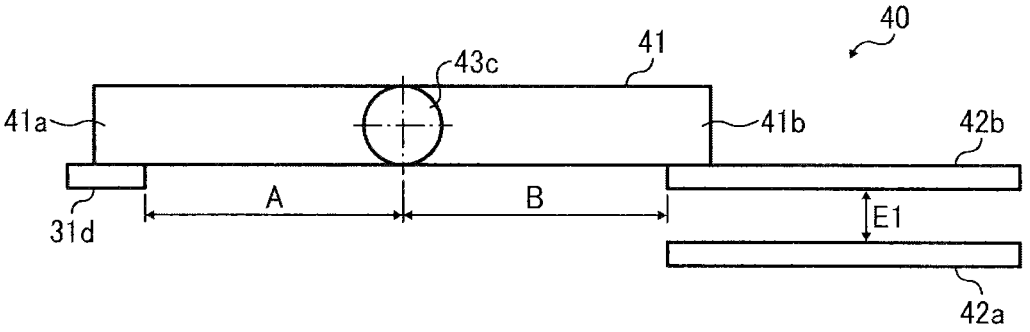
FIGS. 11A and 11B are schematic views illustrating a comparative example of a configuration of a lubricant gauge.
Figure 11B:
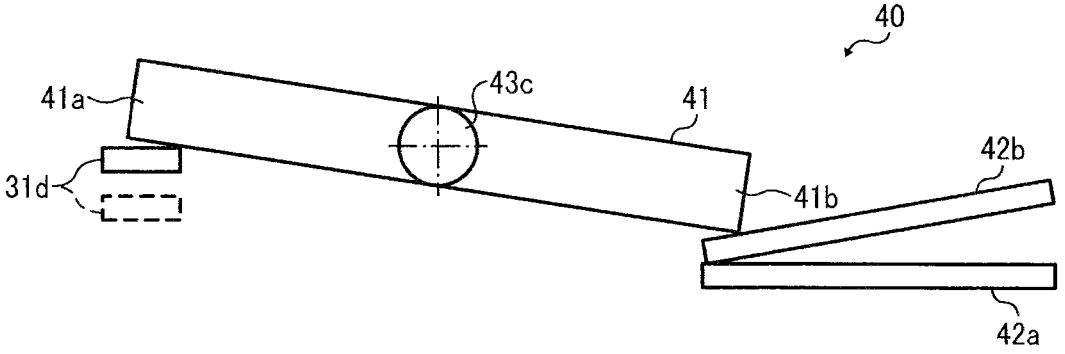

FIGS. 11A and 11B are schematic views illustrating a comparative example of a configuration of the lubricant gauge 40. In the comparative example, the length A from the rotary shaft 43*c* to the contact part 41*a* of the rotary member 41 against which the pressing member 31*d* of the lubricant holder 3*d* presses, that is, the left end of the rotary member 41 in FIGS. 11A and 11B, is substantially equal to the length B from the rotary shaft 43*c* to the detection part 41*b* of the rotary member 41 that presses the second electrode member 42*b* against the first electrode member 42*a*, that is, the right end of the rotary member 41. In such a configuration, the detection part 41*b* of the rotary member 41 presses the second electrode member 42*b* against the first electrode member 42*a* with the same amount of force as which the contact part 41*a* of the rotary member 41 is pressed by the pressing member 31*d*. Thus, in a case in which a gap E1 is formed between the first and second electrode members 42*a* and 42*b*, the second electrode member 42*b* contacts the first electrode member 42*a* when the pressing member 31*d* presses against the contact part 41*a* of the rotary member 41 with a predetermined amount of force as illustrated in FIG. 11B.

The pressing member 31*d* of the lubricant holder 3*d* presses against the rotary member 41 so that the second electrode member 42*b* elastically deforms. As a result, a contact pressure of the solid lubricant 3*b* against the application roller 3*a* is reduced by a reactive force from the second electrode member 42*b*. Reduction in the contact pressure reduces the amount of lubricant scraped off by the application roller 3*a*, thereby reducing an amount of lubricant supplied to the surface of the photoconductor 1. Therefore, conceivably, it is preferable that the pressing member 31*d* of the lubricant holder 3*d* press against the rotary member 41 immediately before the solid lubricant 3*b* reaches the near-end stage. However, if it is designed to press against the rotary member 41 immediately before the near-end stage of the solid lubricant 3*b*, the pressing member 31*d* presses against the rotary member 41 with a small amount of force when the solid lubricant 3*b* reaches the near-end stage. Thus, in the case of FIG. 11A in which the detection part 41*b* of the rotary member 41 presses the second electrode member 42*b* against the first electrode member 42*a* with the same amount of force as which the contact part 41*a* of the rotary member 41 is pressed by the pressing member 31*d*, the gap E1 between the first and second electrode members 42*a* and 42*b* is set small. Consequently, if the second electrode member 42*b* vibrates due to vibration generated in the image forming apparatus 10 or the like, the second electrode member 42*b* inadvertently contacts the first electrode member 42*a*. As a result, in spite of the fact that the solid lubricant 3*b* does not reach the near-end stage yet, electrical continuity is established between the first and second electrode members 42*a* and 42*b*, and therefore, the lubricant gauge 40 erroneously detects the near-end stage of the solid lubricant 3*b*.

Figure 12A:
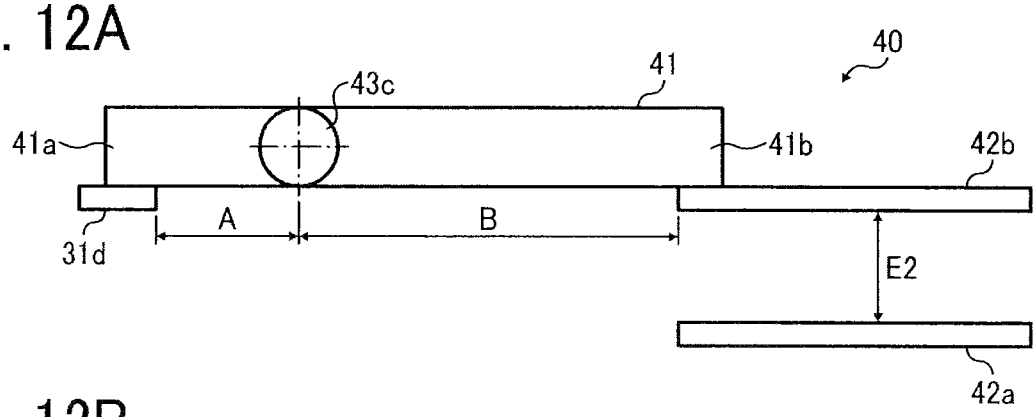
FIGS. 12A and 12B are schematic views of the lubricant gauge according to the illustrative embodiment.
Figure 12B:
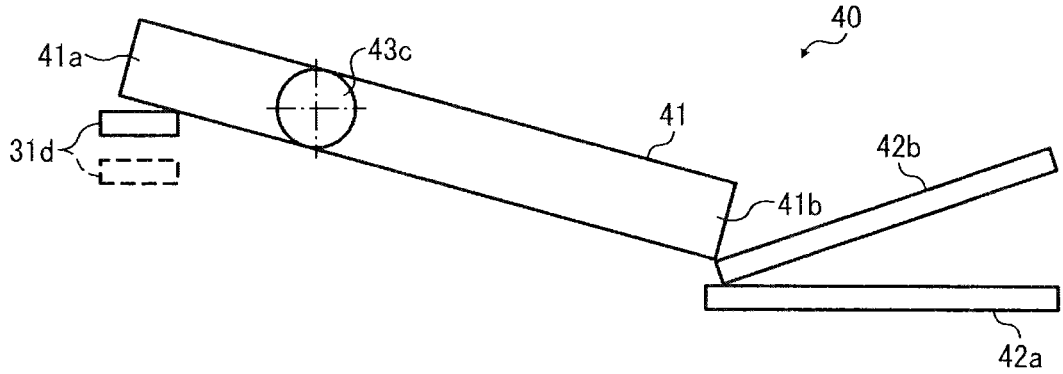

By contrast, in the case of the present illustrative embodiment as illustrated in FIG. 12A, the length A from the rotary shaft 43*c* to the contact part 41*a* of the rotary member 41, against which the pressing member 31*d* of the lubricant holder 3*d* presses, that is, the left end of the rotary member 41, is shorter than the length B from the rotary shaft 43*c* to the detection part 41*b* of the rotary member 41 that presses the second electrode member 42*b* against the first electrode member 42*a*, that is, the right end of the rotary member 41. Accordingly, the detection part 41*b* of the rotary member 41 presses the second electrode member 42*b* against the first electrode member 42*a* with an amount of force larger than the amount of force in which the contact part 41*a* of the rotary member 41 is pressed by the pressing member 31*d*. In such a case, when a gap E2, which is larger than the gap E1 illustrated in FIG. 11A, is formed between the first and second electrode members 42*a* and 42*b*, the second electrode member 42*b* contacts the first electrode member 42*a* when the pressing member 31*d* presses against the contact part 41*a* of the rotary member 41 with a predetermined amount of force as illustrated in FIG. 12B. As a result, although the pressing member 31*d* presses against the rotary member 41 with a small amount of force, the rotary member 41 presses the second electrode member 42*b* against the first electrode member 42*a* with an increased amount of force, thereby allowing a size of the gap E2 between the first and second electrode members 42*a* and 42*b* to be increased. Accordingly, even in the case in which the pressing member 31*d* is designed to press against the rotary member 41 immediately before the near-end stage of the solid lubricant 3*b*, the relatively large gap E2 is formed between the first and second electrode members 42*a* and 42*b*. As a result, when the second electrode member 42*b* vibrates due to vibration generated in the image forming apparatus 10 or the like, the second electrode member 42*b* does not inadvertently contact the first electrode member 42*a*. Thus, the near-end stage of the solid lubricant 3*b* is accurately detected.

Figure 13A:
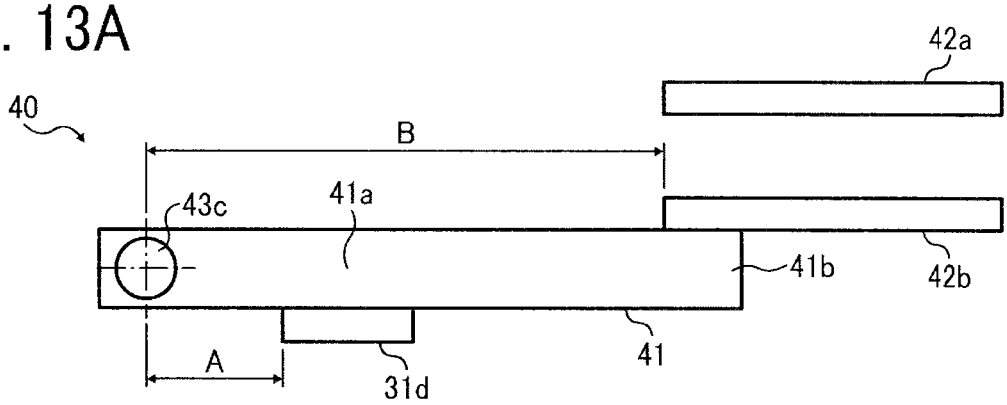
FIGS. 13A and 13B are schematic views illustrating an example of a configuration of a lubricant gauge according to a variation of the illustrative embodiment.
Figure 13B:
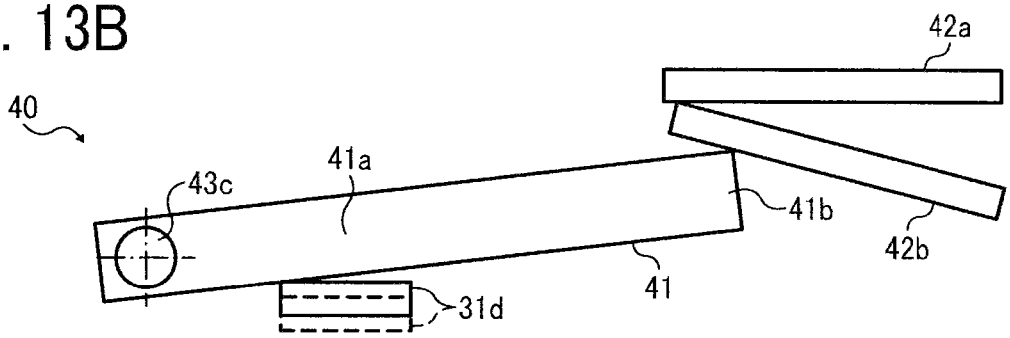

It is to be noted that the configuration of the lubricant gauge 40 is not limited to the above-described example. Alternatively, the lubricant gauge 40 may have a configuration described below with reference to FIGS. 13A and 13B. FIGS. 13A and 13B are schematic views illustrating an example of a configuration of the lubricant gauge 40 according to a variation of the present illustrative embodiment.

In the variation, the pivot of the rotary member 41, that is, the rotary shaft 43*c*, is positioned at the left end of the rotary member 41 in FIGS. 13A and 13B, the contact part 41*a* of the rotary member 41, against which the pressing member 31*d* of the lubricant holder 3*d* presses, is positioned substantially at the center of the rotary member 41 in the longitudinal direction, and the detection part 41*b* of the rotary member 41, which presses the second electrode member 42*b* against the first electrode member 42*a*, is positioned at the right end of the rotary member 41. In such a configuration, the length B from the rotary shaft 43*c* to the detection part 41*b* of the rotary member 41, which presses the second electrode member 42*b* against the first electrode member 42*a*, is still set longer than the length A from the rotary shaft 43*c* to the contact part 41*a* of the rotary member 41, against which the pressing member 31*d* of the lubricant holder 3*d* presses.

As described previously, the lubricant gauge 40 is disposed near both ends of the solid lubricant 3*b* in the longitudinal direction. Thus, even when the solid lubricant 3*b* is consumed at different rates at both ends thereof in the longitudinal direction, upon reaching the near-end stage at one end of the solid lubricant 3*b*, the lubricant gauge 40 provided near that end detects the near-end stage of the solid lubricant 3*b*. As a result, the near-end stage of the solid lubricant 3*b* at either end thereof is reliably detected, thereby preventing damage to the surface of the photoconductor 1 due to insufficient supply of the lubricant to the surface of the photoconductor 1.

Figure 14:
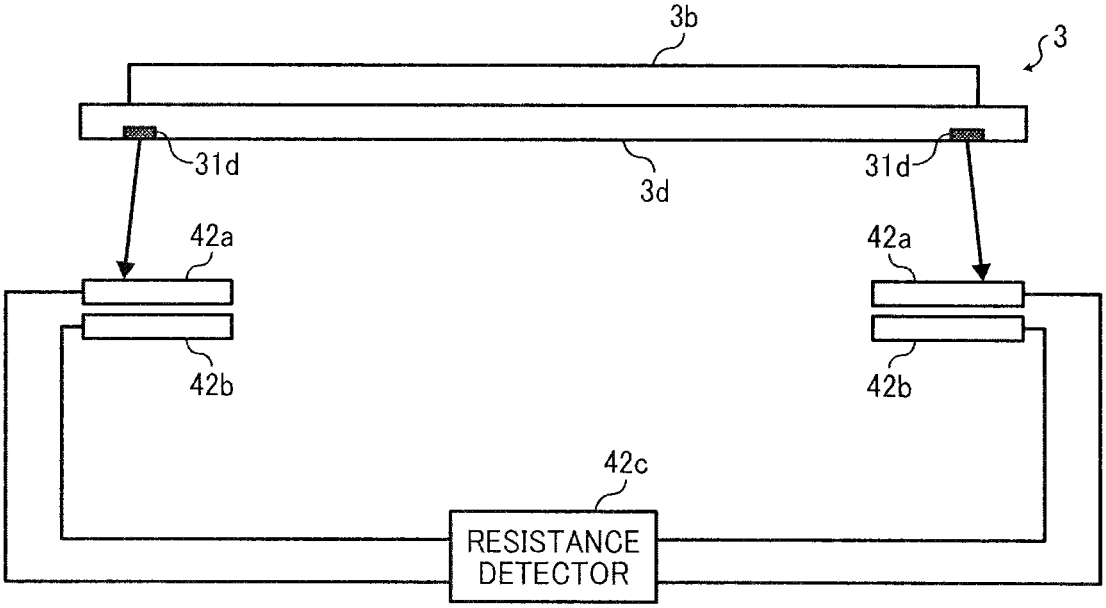
FIG. 14 is a schematic view illustrating another example of a configuration of the lubricant gauge according to the illustrative embodiment.
Figure 15:
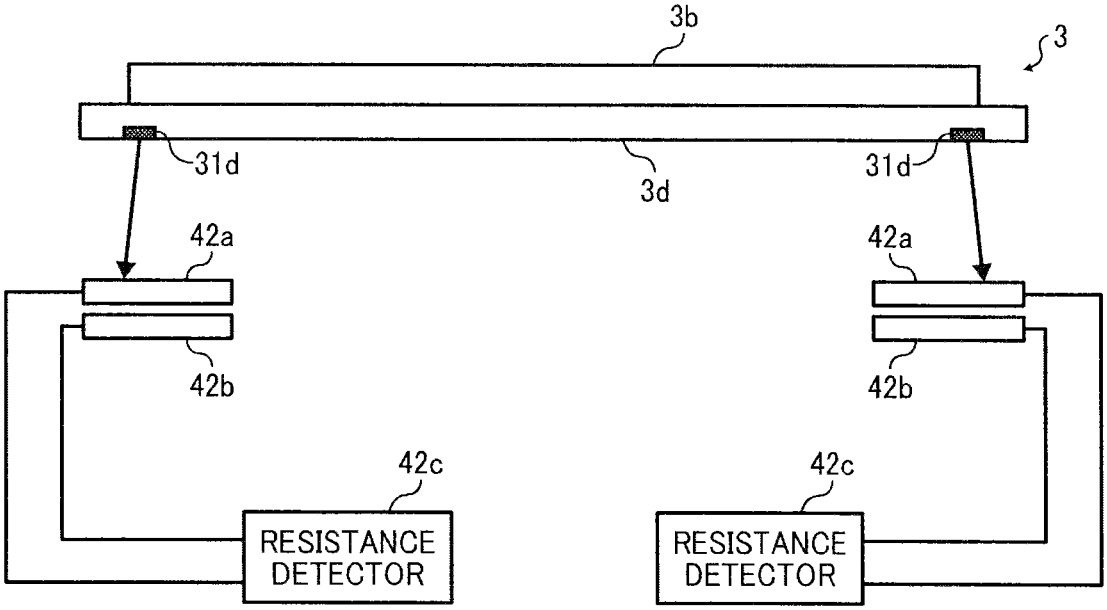
FIG. 15 is a schematic view illustrating yet another example of a configuration of the lubricant gauge according to the illustrative embodiment.
Figure 16A:
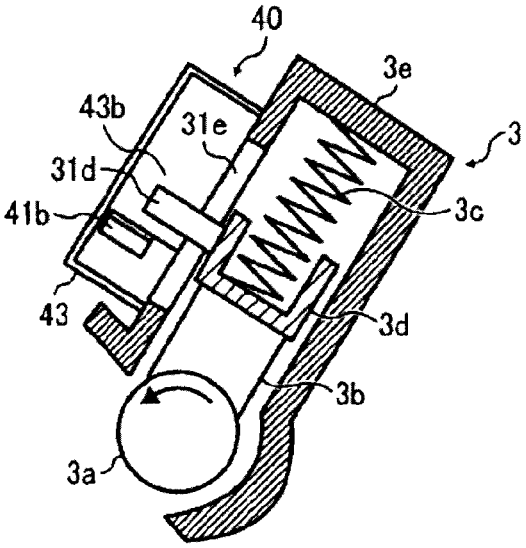
FIG. 16A is a vertical cross-sectional view of the lubricant gauge disposed outside the casing of FIG. 9A.
Figure 16B:
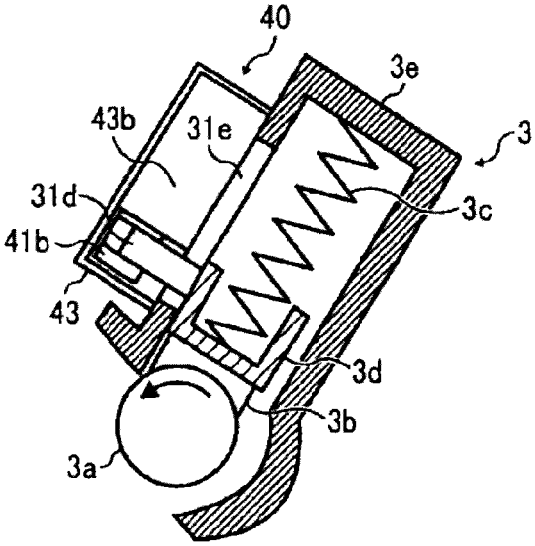
FIG. 16B is a vertical cross-sectional view of the lubricant gauge disposed outside the casing of FIG. 9B.

As illustrated in FIG. 14, the lubricant applicator 3 may include the single resistance detector 42*c* dedicated to both lubricant gauges 40. Alternatively, the resistance detectors 42*c* dedicated to the respective lubricant gauges 40 may be provided as illustrated in FIG. 15. In the case of FIG. 15 in which separate resistance detectors 42*c* are provided to each of the respective lubricant gauges 40, which end of the solid lubricant 3*b* in the longitudinal direction reaches the near-end stage is reliably detected.

It is to be noted that, in the present illustrative embodiment, the lubricant gauge 40 detects a state in which the solid lubricant 3*b* still has a slight amount remaining to be supplied to the surface of the photoconductor 1 for predetermined number of sequences of image formation. By contrast, if the lubricant gauge 40 detects the last stage of use of the solid lubricant 3*b* immediately before exhaustion of the solid lubricant 3*b*, image formation is prohibited until the solid lubricant 3*b* is replaced with a new solid lubricant 3*b* in order to prevent irregular image formation caused by exhaustion of the solid lubricant 3*b*, thereby causing a downtime.

In the present illustrative embodiment, the near-end stage of the solid lubricant 3*b* is detected as described above. Accordingly, the lubricant is still supplied to the surface of the photoconductor 1 for the predetermined number of sequences of image formation even after the detection of the near-end stage, thereby securely protecting the surface of the photoconductor 1. As a result, image formation is performed without the downtime even after the detection until the replacement of the solid lubricant 3*b*. However, if image formation is performed at the predetermined number of sequences before the replacement of the solid lubricant 3*b*, the solid lubricant 3*b* is used up, causing the problems described above. To prevent this problem, when the near-end stage of the solid lubricant 3*b* is detected, the cumulative distance traveled by the application roller 3*a*, the number of sequences of image formation performed, or the like is monitored. When the cumulative distance traveled by the application roller 3*a*, the number of sequences of image formation performed, or the like reaches a predetermined value, it is detected that the solid lubricant 3*b* is in the last stage of use to prohibit image formation.

It is preferable that the rotary member 41 be formed of a nonconductive material such as resin. To preferably hold the solid lubricant 3*b*, the lubricant holder 3*d* is formed of sheet metal so that a bonded face of the lubricant holder 3*d*, to which the solid lubricant 3*b* is bonded, has an improved levelness. If the rotary member 41 is formed of a conductive material, when the pressing member 31*d* of the lubricant holder 3*d* contacts the rotary member 41, a voltage applied to the second electrode member 42*b* is further applied to the lubricant holder 3*d* via the rotary member 41. As a result, the solid lubricant 3*b* held by the lubricant holder 3*d* may be also charged and thus the charged lubricant may be supplied to the surface of the photoconductor 1, thereby adversely affecting the resultant images. By contrast, the rotary member 41 formed of a nonconductive material such as resin prevents the solid lubricant 3*b* from being charged.

In the present illustrative embodiment, a direction in which the rotary member 41 is rotated by gravity is opposite a direction in which the rotary member 41 is rotated as the solid lubricant 3*b* is consumed. Unlike the present illustrative embodiment, if the rotary member 41 is rotated in the same direction either by gravity or consumption of the solid lubricant 3*b*, a restriction member constructed of a biasing member such as a spring is further provided to bias the rotary member 41 toward the direction opposite the direction in which the rotary member 41 is rotated by gravity, thereby preventing the rotary member 41 from being rotated by gravity. In such a configuration, a biasing force of the spring is increased when the pressing member 31*d* of the lubricant holder 3*d* presses against the rotary member 41 to rotate the rotary member 41 as the solid lubricant 3*b* is consumed. Consequently, as the solid lubricant 3*b* approaches the near-end stage, the contact pressure of the solid lubricant 3*b* against the application roller 3*a* is reduced, thereby reducing the amount of lubricant supplied to the surface of the photoconductor 1.

By contrast, in the present illustrative embodiment, the direction in which the rotary member 41 is rotated by gravity is opposite the direction in which the rotary member 41 is rotated as the solid lubricant 3*b* is consumed, thereby eliminating provision of the spring described above. Thus, the contact pressure of the solid lubricant 3*b* against the application roller 3*a* is kept constant. As a result, a fluctuation in the amount of lubricant supplied to the surface of the photoconductor 1 is suppressed compared to the case in which the rotary member 41 is rotated in the same direction either by gravity or consumption of the solid lubricant 3*b*.

It is to be noted that, in place of the first and second electrode members 42*a* and 42*b*, a push switch may be used for detecting the rotation of the rotary member 41. In such a configuration, when the rotary member 41 is moved to the position that indicates the near-end stage of the solid lubricant 3*b*, the detection part 41*b* of the rotary member 41 presses the push switch to detect the near-end stage of the solid lubricant 3*b*. However, in a case in which the push switch is employed in the configuration illustrated as the comparative example in FIGS. 11A and 11B, a distance between the rotary member 41 and the push switch is narrowed. Consequently, if vibrated due to vibration generated in the image forming apparatus 10 or the like, the rotary member 41 may inadvertently press the push switch, causing erroneous detection of the near-end stage of the solid lubricant 3*b*. By contrast, in a case in which the push switch is employed in the configuration according to the present illustrative embodiment illustrated in FIGS. 12A and 12B, a distance between the rotary member 41 and the push switch is increased, thereby reliably detecting the near-end stage of the solid lubricant 3*b*.

Alternatively, the rotation of the rotary member 41 may be detected by a photointerrupter. In such a configuration, when the rotary member 41 is moved to the position that indicates the near-end stage of the solid lubricant 3*b*, the rotary member 41 cuts off light to detect the near-end stage of the solid lubricant 3*b*. Further alternatively, the near-end stage of the solid lubricant 3*b* may be detected by a photoreflector. In such a case, a reflector is provided to the rotary member 41 at a position opposite the photoreflector. When the rotary member 41 is moved to the position that indicates the near-end stage of the solid lubricant 3*b*, the rotary member 41 reflects light emitted from the photoreflector. The light thus reflected by the rotary member 41 is received by the photoreflector so that the near-end stage of the solid lubricant 3*b* is detected. However, in a case in which either the photointerrupter or the photoreflector is employed in the configuration illustrated as the comparative example in FIGS. 11A and 11B, when the rotary member 41 is inadvertently rotated due to vibration generated in the image forming apparatus 10 or the like, a part of the rotary member 41 is positioned opposite the photointerrupter or the photoreflector, thereby possibly causing erroneous detection of the near-end stage of the solid lubricant 3*b*. By contrast, in a case in which either the photointerrupter or the photoreflector is employed in the configuration according to the present illustrative embodiment illustrated in FIGS. 12A and 12B, a part of the rotary member 41 is not positioned opposite the photointerrupter or the photoreflector even when the rotary member 41 is inadvertently rotated due to vibration generated in the image forming apparatus 10 or the like, thereby reliably detecting the near-end stage of the solid lubricant 3*b*.

The foregoing illustrative embodiment is applicable to a lubricant applicator that supplies lubricant to the intermediate transfer belt 56.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. A lubricant applicator, comprising:
a lubricant;
a supply member contactable against the lubricant; and
a lubricant detector to detect whether a remaining amount of lubricant is less than a threshold value, the lubricant detector comprising:
a rotary member rotatable about a pivot;
a pressing member disposed opposed to the rotary member to rotate the rotary member by pressing a contact part of the rotary member; and
a detection part of the rotary member opposite to the contact part across the pivot of the rotary member,
wherein a length of the rotary member from the pivot to the detection part is longer than a length of the rotary member from the pivot to the contact part.

2. The lubricant applicator according to claim 1, further comprising:
a first electrode; and
a second electrode disposed opposed to the first electrode, the second electrode being pressed against the first electrode by the rotary member,
wherein whether the remaining amount of lubricant is less than the threshold value is detected based on establishment of electrical continuity between the first electrode and the second electrode.

3. The lubricant applicator according to claim 1, further comprising a casing to accommodate the lubricant,
wherein the lubricant detector is disposed outside the casing.

4. The lubricant applicator according to claim 3, further comprising:
an opening formed in the casing, through which the pressing member penetrates; and
a cover member to cover the lubricant detector and the opening.

5. The lubricant applicator according to claim 4, further comprising a partition that divides an interior encompassed by the cover member into a part in which the opening is provided and a part in which the first electrode and the second electrode are disposed.

6. The lubricant applicator according to claim 4, wherein the cover member holds the lubricant detector.

7. The lubricant applicator according to claim 1, wherein the lubricant detector is disposed adjacent to both ends of the lubricant in a longitudinal direction of the lubricant.

8. The lubricant applicator according to claim 1, wherein the lubricant includes a fatty acid metal salt.

9. The lubricant applicator according to claim 1, wherein the lubricant includes an inorganic lubricant.

10. The lubricant applicator according to claim 1,
wherein the supply member rotates, and
the rotary member rotates in a direction intersecting with a direction which the supply member rotates.

11. An image forming apparatus, comprising:
an image carrier, from which an image formed thereon is transferred onto a recording medium to form the image on the recording medium; and
a lubricant applicator disposed opposed to the image carrier to supply a lubricant to a surface of the image carrier, the lubricant applicator comprising:
a lubricant;
a supply member contactable against the lubricant; and
a lubricant detector to detect whether a remaining amount of lubricant is less than a threshold value, the lubricant detector comprising:
a rotary member rotatable about a pivot;
a pressing member disposed opposed to the rotary member to rotate the rotary member by pressing a contact part of the rotary member; and
a detection part of the rotary member opposite to the contact part across the pivot of the rotary member,
wherein a length of the rotary member from the pivot to the detection part being longer than a length of the rotary member from the pivot to the contact part.

12. A process cartridge detachably installable in an image forming apparatus, comprising:
an image carrier; and
a lubricant applicator disposed opposed to the image carrier to supply a lubricant to a surface of the image carrier, the lubricant applicator comprising:
a lubricant;
a supply member contactable against the lubricant; and
a lubricant detector to detect whether a remaining amount of lubricant is less than a threshold value, the lubricant detector comprising:
a rotary member rotatable about a pivot;
a pressing member disposed opposed to the rotary member to rotate the rotary member by pressing a contact part of the rotary member; and
a detection part of the rotary member opposite to the contact part across the pivot of the rotary member,
wherein a length of the rotary member from the pivot to the detection part being longer than a length of the rotary member from the pivot to the contact part.

* * * * *